United States Patent [19]

Tashiro

[11] 4,300,072

[45] Nov. 10, 1981

[54] MAGNETRON HAVING AN INTERNAL CAPACITOR FOR SUPPRESSING LEAKAGE OF HIGH FREQUENCY

[75] Inventor: Norio Tashiro, Yokohama, Japan

[73] Assignee: Tokyo Shibaura Denki Kabushiki Kaisha, Kawasaki, Japan

[21] Appl. No.: 116,592

[22] Filed: Jan. 28, 1980

[30] Foreign Application Priority Data

Feb. 1, 1979 [JP] Japan ..... 54-10806

[51] Int. Cl.[3] ..... H01J 25/50

[52] U.S. Cl. ..... 315/39.51; 315/39.53; 315/39.75; 315/85

[58] Field of Search ..... 315/39.51, 39.53, 39.75, 315/39.77, 85

[56] References Cited

U.S. PATENT DOCUMENTS

| | | | |
|---|---|---|---|
| 3,543,082 | 11/1979 | Boehm | 315/39.53 X |
| 3,551,735 | 12/1970 | Staats | 315/39.77 |
| 3,588,589 | 6/1971 | Vonk | 315/39.53 |
| 3,846,667 | 11/1974 | Hisada et al. | 315/39.53 |
| 4,131,824 | 12/1978 | Nakai et al. | 315/39.53 |
| 4,156,829 | 5/1979 | Harada | 315/39.51 |
| 4,163,175 | 7/1979 | Tashiro | 315/39.51 |
| 4,223,245 | 9/1980 | Ogura et al. | 315/39.51 |

*Primary Examiner*—Saxfield Chatmon, Jr.
*Attorney, Agent, or Firm*—Cushman, Darby & Cushman

[57] ABSTRACT

A magnetron is provided with an anode cylinder having a number of resonance cavities defined in the anode cylinder and a cathode disposed along the axis of the anode cylinder. The anode cylinder is hermetically sealed by cover plates. An antenna section electrically connected to the resonance cavities is mounted on one of the cover plates, and a cylindrical envelope of a cathode stem is mounted on the other cover plate. Within the cylindrical envelope are disposed a rod holder electrically connected to one end of the cathode and a cylindrical holder connected to the other end of the cathode, the rod holder extending through the cylindrical holder, and the cathode is supported by both the holders. Within the cylindrical envelope is further disposed a dielectric cylinder, through which the cylindrical holder extends. The dielectric cylinder is provided with an outer electrical conductive metal layer formed on its outer surface and extending from one end of its and also with an inner electrical conductive metal layer formed on its inner surface and extending from the other end of it, these inner and outer metal layers partly opposing each other. The outer metal layer is electrically connected to the cathode, and the inner metal layer is electrically connected to the anode cylinder.

11 Claims, 5 Drawing Figures

MAGNETRON HAVING AN INTERNAL CAPACITOR FOR SUPPRESSING LEAKAGE OF HIGH FREQUENCY

BACKGROUND OF THE INVENTION

This invention relates to a magnetron having an internal capacitor for suppressing high frequency leakage and, more particularly, to improvements in the cathode stem structure of a magnetron.

A known magnetron produces a fundamental high frequency wave, for instance 2,450 MHz. In the magnetron high frequency noises in a wide frequency range from several KHz to GHz is generated from various grounds. The fundamental high frequency wave and the high frequency noises at harmonic frequencies and other high frequencies in the UHF band, VHF band and radio band are likely to leak from the magnetron, particularly from a cathode terminal of the magnetron cathode stem, and adversely affect other electronic equipment and human body. In order to prevent the fundamental frequency and high frequency noise leakage, the cathode stem of the magnetron is received in a shield box, and the cathode terminals of the cathode stem are electrically connected to LC filters. The impedance of these LC filters is generally determined in dependence upon the high frequency noise to be suppressed. However, even if the LC filters are properly selected to have a proper value against noises, the LC filters affect the oscillation of the magnetron and also cause a standing wave to be produced in power supply lines connected to the cathode terminals, if the power supply line including LC filters is improperly designed.

If, for example, the power supply line is undesirably designed, an unrequired resonance path including power supply line is formed at the fundamental high frequency and an output from an output section becomes unstable. At the time of presence of resonance the microwave output from the output section of the magnetron is likely to reduce the efficiency of the magnetron. Further, at the time of the resonance electrons are likely to intensively bombard the cathode in the resonance cavity to deteriorate emission of electrons from the cathode. Furthermore, depending upon the impedance of the LC filter it is likely that the high frequency noise spectrum is changed to shift the maximum level noise frequency range from the intended range to another particular range, thus practically disabling the suppression of high frequency noise with the LC filters. Further, even if the impedance of the LC filters is adequately selected with respect to the high frequency noise, considerable amount of microwave power is likely to be absorbed by the LC filters thereby burning the choking element of the LC filters. Because the method of suppressing high frequency noise by connecting LC filters to the cathode terminals of the cathode stem has various problems as mentioned above, there has been proposed a magnetron having internal capacitors formed within the cathode stem, disclosed in U.S. Pat. No. 4,163,175, applied by Tashiro, the inventor of the invention of the instant application. In this magnetron, a first internal capacitor is formed between cathode holders within the cathode stem for the purpose of attenuating high frequency noise transmitted through heater lines through which heater current is supplied to the cathode. In addition, a second internal capacitor is formed between a cathode holder and an anode cylinder within the cathode stem in order to attenuate high frequency noise transmitted through high voltage supply lines through which a high voltage is supplied between the cathode and anode. With this magnetron provided with the first and second internal capacitors, disclosed in U.S. Pat. No. 4,163,175, particularly the fundamental high frequency produced in the resonance cavity of the magnetron can be suppressed by the first and second internal capacitors, so that it is possible to comparatively freely select the impedance of the LC filters connected to the cathode terminals of the cathode stem and thus effectively suppress the high frequency noise. However, the disclosed magnetron has a problem in that a high voltage which is applied between the cathode holder and anode cylinder, is likely to cause dielectric breakdown of the second capacitor and thus cause surface discharge or creeping discharge through the surfaces of the dielectric member constituting the second capacitor.

SUMMARY OF THE INVENTION

An object of the invention is to provide a magnetron having a cathode stem structure capable of preventing high frequency leakage through power supply lines.

Another object of the invention is to provide a magnetron having a cathode stem with a capacitor having a sufficiently high and adequate capacitance formed between an anode cylinder and a cathode holder.

According to the invention, there is provided a magnetron comprising an anode cylinder having a number of resonance cavities defined in the anode cylinder, a cathode disposed along the axis of the anode cylinder, a cover means hermetically sealing the anode cylinder, a cathode holding means for supporting the cathode protruding from the cover means, the cathode holding means being disposed along the axis of the anode cylinder, a cylindrical envelope coaxial with the anode cylinder and hermetically sealing the cathode holding means, a cylindrical member made of a dielectric material and coaxially disposed within the envelope, an inner electrical conductive layer extending along the inner surface of the cylindrical member from one end thereof, and an outer electrical conductive layer extending along the outer surface of the cylindrical member from the other end thereof, one of these conductive layers being electrically connected to the anode cylinder, the other layer being electrically connected to the cathode.

Also, according to the invention, there is provided a magnetron, in which a cylindrical member is assembled in a cylindrical envelope, with electric conductive layers formed on the outer and inner surfaces of the cylindrical member.

DETAILED DESCRIPTION OF THE PREFERRED EMBODIMENT

Figure 1:
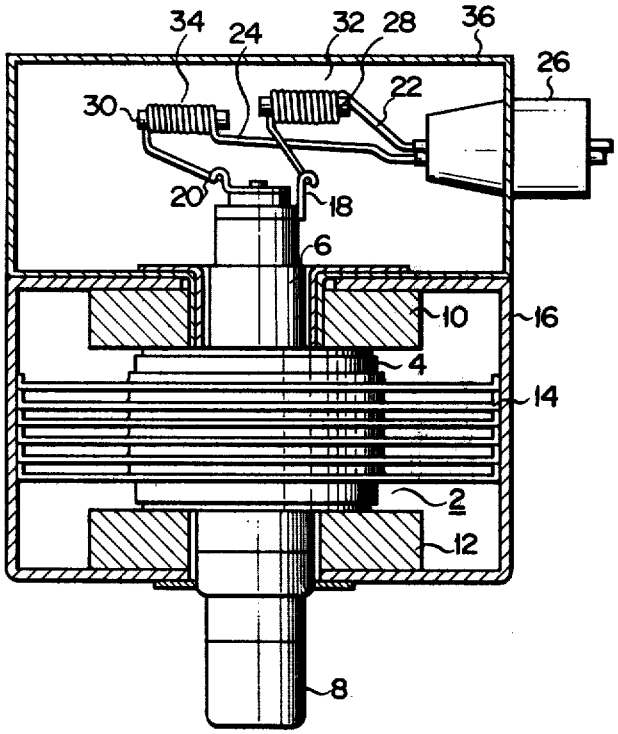
FIG. 1 is a schematic sectional view showing a magnetron device, in which a magnetron according to the invention is assembled.

Referring to FIG. 1, a magnetron device in which a magnetron 2 according to the invention is assembled is shown. As shown in FIG. 1, the magnetron 2 is of an external magnet type comprising a magnetron body 4, a cathode stem 6 and a microwave output section 8. As will be made apparent from the following, the invention relates to the internal structure of the magnetron cathode stem, so that it can as well be applied to magnetrons of an internal magnet type (which are not shown). In the illustrated magnetron of the external magnet type, the magnetron body 4 is disposed between pair permanent magnets 10 and 12, and it has cooling fins 14 mounted on its outer surface. The pair permanent magnets 10 and 12 are magnetically coupled together by a magnetic yoke 16. The cathode stem 6 has cathode terminals 18 and 20, to which power supply lines 22 and 24 are respectively electrically connected. These power supply lines 22 and 24 are electrically connected to a feed-through type capacitor 26. These power supply lines 22 and 24 are partly wound on respective ferrite cores 28 and 30 to form choking elements 32 and 34. The choking elements 32 and 34 and capacitor 26 constitute LC filters for suppressing high frequencies leaking through the cathode terminals 18 and 20. The choking elements 32 and 34, power supply lines 22 and 24 and cathode stem 6 are received within a shield box 36 for shielding high frequencies propagated from the cathode terminals 18 and 20, power supply lines 22 and 24, etc.

Figure 2:
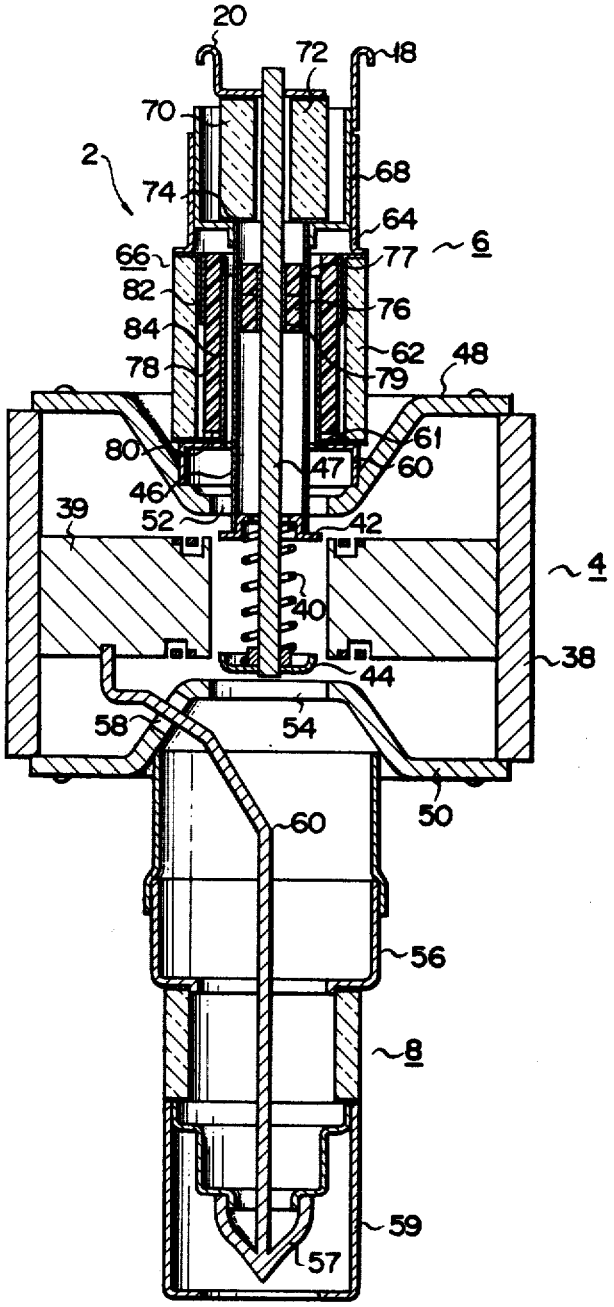
FIG. 2 is a sectional view showing an embodiment of the magnetron according to the invention.
Figure 3:
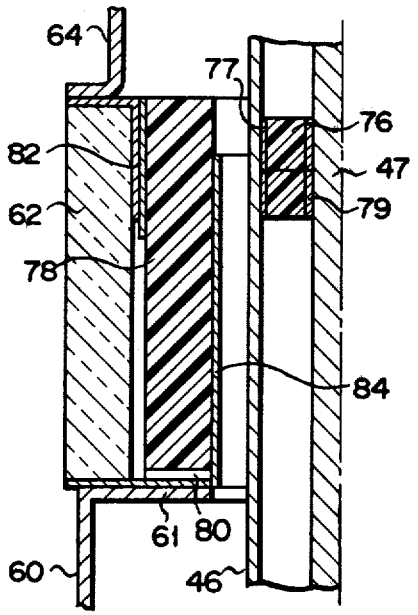
FIG. 3 is a fragmentary enlarged-scale sectional view showing a cathode stem of the magnetron shown in FIG. 1.

Referring now to FIGS. 2 and 3, the magnetron shown in FIG. 1 is shown in a detailed sectional view. As is well known in the art, the magnetron body 4 includes an anode cylinder 38 of copper, which has a number of radially spaced anode vanes 39 secured to its inner wall surface, with resonance cavities being defined between adjacent anode vanes 39. A cathode filament 40 in the form of a coil, made of carburized thorium tungsten, is disposed in the anode cylinder 38 along the axis thereof. It is interposed between and supported by first and second end hats 42 and 44 made of molybdenum. The first end hat 42 is secured to one end of a cylindrical cathode holder 46 made of molybdenum, and the second end hat 44 is secured to one end of a rod-like cathode holder 47 made of molybdenum extending through the central hole of the first end hat 42 and the cylindrical cathode holder 46. The open ends of the anode cylinder 38 is hermetically sealed by cover plates 48 and 50 having respective openings 52 and 54, the space inside the cylinder 38 is held in vacuum. The cover plates 48 and 50 are made of a magnetic material so that they serve as pole pices in the magnetron of the external magnet type, with their inner peripheral edges disposed in the close proximity of the inter-action space so that a magnetic field may be produced in the interaction space. A cylindrical envelope 56 of the microwave output section 8 is hermetically mounted on the cover plate 50. The cover plate 50 is furthr provided with a through hole 58, through which an antenna rod 60 is extended, one end of the antenna rod 60 being connected to the vane 39 and other end thereof being connected to an exhaust tube 57 mounted on the end of the cylindrical envelope 56. The exhaust tube 57 is received in an output cap 59 mounted on the cylindrical envelope 56.

The cathode stem 6 is hermetically mounted in the cover plate 48. The cylindrical cathode holder 46 is disposed in an envelope 66 which includes a metal cylinder 60 made of Kovar, hermetically mounted on the cover plate 48 and having a supporting flange 61, a ceramic cylinder 62 coaxially sealed to the metal cylinder 60 and a metal cylinder 64 made of Kovar and coaxially sealed to the ceramic cylinder 62. A cylindrical cap 68 is hermetically fitted on and secured to the other end of the metal cylinder 64. Thus, the inner space of the cylinder 66 is held in vacuum. The cylindrical cap 68 is connected to one of the cathode terminals, namely cathode terminal 18, as shown in FIG. 2. The rod cathode holder 47 projects from the other open end of the cylindrical cathode holder 46 and extends through an alumina ceramic cylindrical member 70. The cylindrical member 70 is provided for insulation with respect to an input voltage of about 3 volts applied between the anode filament terminals 18 and 20, and it has electrical conductive metal layers 72 and 74 formed on the opposite end faces by the silver sintering method. The metal layer 72 is connected to the cathode terminal 20 connected to the rod cathode holder 47, and the other metal layer 74 is connected to the cylindrical cap 68. The cathode terminal 20 hermetically seals the cylindrical member 70. The inside of the cylindrical cathode holder 46 and cylindrical member 70 are held in vacuum. As is shown in detail in FIG. 3, between cylindrical cathode holder 46 and rod cathode holder 47 is interposed a dielectric ring member 76, which is made of a highly dielectric material composed of strontium titanate or the like, and through which the rod cathode holder 47 extends. The dielectric ring member 76 has metalized layers 77 and 79 made of silver formed on its inner and outer surfaces also by the silver sintering method. The metal layer 79 is electrically connected to the rod cathode holder 47, and the metal layer 77 is electrically connected to the cylindrical cathode holder 46. Thus, a capacitor is formed by the ring member 76 between the rod cathode holder 47 and cylindrical cathode holder 46. Strontium titanate has a dielectric constant of about 230 at room temperature and causes little dielectric loss. The dielectric constant of strontium titanate is reduced at 500° C. to one half the value at normal temperature, but a capacitor having a capacitance of 20 to 50 pF can be readily formed by using strontium titanate as the highly dielectric material of the dielectric ring member 76.

As is shown in FIG. 2, a dielectric cylinder 78 made of a highly dielectric material such as alumina ceramics is disposed to surround the cylindrical cathode holder 46. The dielectric cylinder 78 is disposed between the cylindrical cathode holder 46 and ceramic cylinder 62 in a coaxial relation to the cylindrical cathode holder 46 and ceramic cylinder 62. The dielectric cylinder 78 is formed with a hole 80 which communicates the space between it and ceramic cylinder 62 and the space between it and cylindrical cathode holder 46. The hole 80 is provided in order that both the spaces may be evacuated in the process of manufacturing the magnetron. The dielectric cylinder 78 has metalized electrical conductive layers 82 and 84 formed on its outer and inner surfaces by the Telefunken method. The metalized electrical conductive layer 84 formed on the inner surface of the dielectric cylinder 78 is connected to the supporting flange 61 of the metal cylinder 60 and extends along the outer surface thereof. The metalized layer 82 formed on the outer surface of the dielectric cylinder 78 is connected to the metal cylinder 64 and extends along the dielectric cylinder up to a position at which it faces the metalized layer 84. Thus, a capacitor is formed by the dielectric material between the pair metalized layers 82 and 84.

Figure 4:
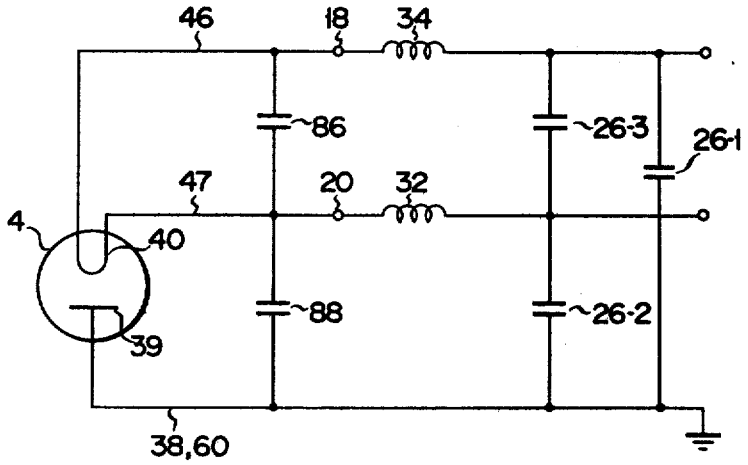
FIG. 4 is an equivalent circuit diagram for the magnetron device shown in FIG. 1.

FIG. 4 shows an equivalent circuit of the magnetron of the above construction. In the Figure, a capacitor 86 is formed by the dielectric ring member 76 and usually has a capacitance of about 40 pF, and a capacitor 88 is formed by the dielectric cylinder 78 and usually has a capacitance of about 10 pF. Capacitors 26-1, 26-2, formed between the cathode heater lines and the anode cylinder by the feed-through type capacitor 26 usually have a capacitance of 500 pF, capacitor 26-3 formed between the cathode heater lines by the feed-through capacitor 26 have a capacitance of 250 pF, and choking coils 32 and 34 usually have an inductance of about 1 $\mu$H.

In the embodiment shown in FIGS. 2 and 3, the dielectric member 78 forming the capacitor 88 has an elongate cylindrical form disposed along the axis of the cathode stem 66, and the capacitance of the capacitor 88 is determined by the dielectric material of the dielectric member 78, the position of the metalized layers 82 and 84 provided on the outer and inner surfaces of the cylinder 78 and the thickness of the cylinder 78. Thus, it is possible to comparatively readily set the capacitance of the capacitor 88 to a suitable value. Since the capacitances of the capacitors 88 and 86 can be set to suitable values, these capacitors 88 and 86 permit to obtain enhanced effect of high frequency separation between the resonance cavities within the magnetron body 4 and external LC filters 32, 34 and 26. Thus, it is possible to prevent such troubles as burning of the choking coils 32 and 34. Further, the metalized layer 82 extends over the outer surface of the dielectric cylinder 78 from one end thereof, while the metalized layer 84 extends over the inner surface of the dielectric cylinder 78 from the other end. This means that is is possible to make the surface distance between the metalized layers 82 and 84 along the dielectric cylinder 78. Thus, even when a high voltage of the order of 8 kV is applied between the metalized layer 82 connected to the cathode terminal 18 and the metalized layer 84 connected to the anode cylinder 38 during the operation of the magnetron, surface discharge or creeping discharge via the surface of the dielectric material will not result. In addition, since the metalized layers 82 and 84 are disposed to surround part of the rod cathode holder 47 and cylindrical cathode holder 46, they can shield high frequencies propagated from these holders 47 and 46.

Figure 5:
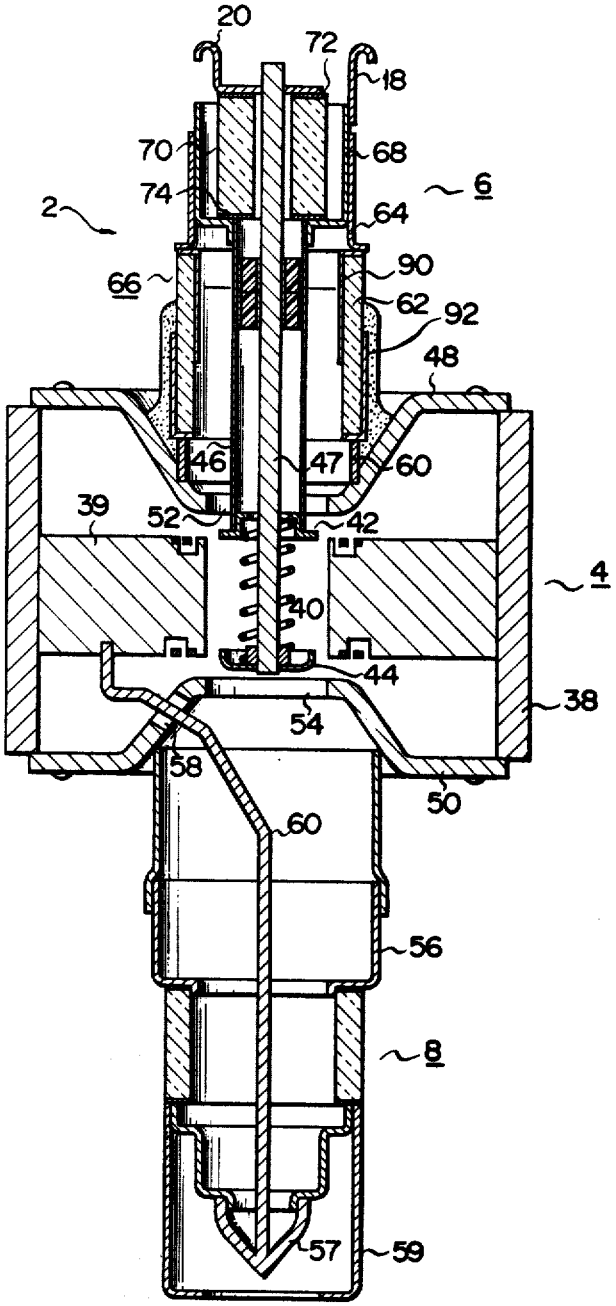
FIG. 5 is a sectional view showing another embodiment of the magnetron according to the invention.

FIG. 5 shows another embodiment of the invention. In this embodiment, the dielectric cylinder 78 in the previous embodiment is not provided, and instead the ceramic cylinder 62 constituting the envelope of the cathode stem 66 is used as the dielectric material that forms the capacitor 88. That is, metalized layers 90 and 92 are formed on the inner and outer surfaces of the ceramic cylinder 62. The inner metalized layer 90 is connected to the metal cylinder 64 and extends along the inner surface of the ceramic cylinder 62 from one end thereof, and the outer metalized layer 92 is electrically connected to the metal cylinder 60 and extends along the outer surface of the ceramic cylinder from the other end thereof. The outer metalized layer 92 is covered with a silicon resin 94 to improve the breakdown voltage.

The inner and outer metalized layers 90 and 92 in the embodiment of FIG. 5 is connected in an opposite way with respect to the inner and outer metalized layers 84 and 82 in the embodiment of FIG. 2; that is, the inner metalized layer 90 is not connected to the anode cylinder 38 but to the cathode terminal 18, and the outer metalized layer 92 is not connected to the cathode terminal 18 but to the anode cylinder 38. Since a high voltage is applied between the anode and cathode, the metalized layer connected to the anode cylinder is desirably connected to the outer surface rather than the inner surface of the dielectric cylinder 62 so that it may be electrically isolated more sufficiently from the cylindrical cathode holder 62 as shown in FIG. 5. In addition, in the embodiment of FIG. 5 the capacitor can be formed without the provision of the dielectric cylinder 80 and also without substantially altering the magnetron construction.

As has been described in the foregoing, according to the invention capacitors having a suitable capacitance for connection between the anode and cathode of the magnetron can be formed within the cathode stem thereof. This enables setting the impedance of the LC filters connected to the cathode terminal of the cathode stem to be set to a proper value without affecting the oscillation of the magnetron. Thus, it is possible to reliably prevent high frequency leakage from the magnetron device.

What is claimed is:

1. A magnetron comprising;

an anode cylinder having a number of resonance cavities defined in the anode cylinder, a cathode disposed along the axis of said anode cylinder, a cover means hermetically sealing said anode cylinder, a cathode holding means for supporting said cathode protruding from said cover means, the cathode holding means being disposed along the axis of said anode cylinder, a cylindrical envelope coaxial with said anode cylinder and hermetically sealing said cathode holding means, a cylindrical member made of a dielectric material and coaxially disposed within said envelope, an inner electrical conductive layer extending along the inner surface of said cylindrical member from one end thereof, and an outer electrical conductive layer extending along the outer surface of said cylindrical member from the other end thereof, one of said conductive layers being electrically connected to said anode, the other conductive layer being electrically connected to said cathode.

2. A magnetron according to claim 1, wherein said outer electrical conductive layer is electrically connected to said cathode, and also wherein said inner electrical conductive layer is electrically connected to said anode cylinder.

3. A magnetron according to claim 1, wherein said cathode holding means includes a cylindrical holder electrically connected to one end of said cathode, and a rod holder extending through said cylindrical holder and electrically connected to the other end of said cathode.

4. A magnetron according to claim 2, which further comprises a dielectric ring made of a dielectric material, said rod holder extending through said dielectric ring, and inner and outer electrical conductive layers respectively formed on the inner and outer surfaces of said dielectric ring and electrically connected to said rod holder and to said cylindrical holder respectively.

5. A magnetron according to claim 1, wherein part of said outer electrical conductive layer and part of said electrical inner metal layer oppose each other.

6. A magnetron comprising;

an anode cylinder having a number of resonance cavities defined in the anode cylinder, a cathode disposed along the axis of said anode cylinder, a cover means hermetically sealing said anode cylinder, a cathode holding means for supporting said cathode protruding from said cover means, the cathode holding means disposed along the axis of said anode cylinder, a cylindrical envelope coaxial with said anode cylinder and hermetically sealing said cathode holding means, said cylindrical envelope including a cylindrical member made of a dielectric material, an inner electrical conductive layer extending along the inner surface of said cylindrical member from one end thereof, and an outer electrical conductive layer extending along the outer surface of said cylindrical member from the other end thereof, one of said electrical conductive layer being electrically connected to said anode, the outer layer being electrically connected to said cathode.

7. A magnetron according to claim 6, wherein said inner conductive layer is electrically connected to said cathode, and also wherein said outer electrical conductive layer is electrically connected to said anode.

8. A magnetron according to claim 6, wherein said cathode holding means includes a cylindrical holder electrically connected to one end of said cathode, and a rod holder extending through said cylindrical holder and electrically connected to the other end of said cathode.

9. A magnetron according to claim 8, which further comprises a dielectric ring made of a dielectric material, said rod holder extending through said dielectric ring, and inner and outer electrical conductive layers respectively formed on the inner and outer surfaces of said dielectric ring, and inner and outer electrical conductive layers connected to said rod holder and to said cylindrical holder.

10. A magnetron according to claim 6, wherein said outer electrical conductive layer is covered with an insulating material.

11. A magnetron according to claim 6, wherein part of said outer electrical conductive layer and part of said inner electrical conductive layer oppose each other.

* * * * *